United States Patent [19]

Cheng

[11] 4,090,879

[45] May 23, 1978

[54] DEVELOPING SOLUTIONS FOR 2-COMPONENT DIAZO-TYPE MATERIALS

[75] Inventor: James K. J. Cheng, Vestal, N.Y.

[73] Assignee: GAF Corporation, New York, N.Y.

[21] Appl. No.: 742,055

[22] Filed: Nov. 15, 1976

[51] Int. Cl.[2] ..... G03C 5/34; G03C 1/58

[52] U.S. Cl. ..... 96/49; 96/75; 96/91 R

[58] Field of Search ..... 96/49, 75, 91

[56] References Cited

U.S. PATENT DOCUMENTS

| | | | |
|---|---|---|---|
| 1,821,281 | 9/1931 | Van der Grinter et al. | 96/49 |
| 2,308,058 | 1/1943 | Crowley, et al. | 96/49 |
| 3,076,707 | 2/1963 | Lawton et al. | 96/75 |
| 3,203,798 | 8/1965 | Muller | 96/49 |
| 3,318,699 | 5/1967 | Lind | 96/49 |
| 3,446,620 | 5/1969 | Parker | 96/49 |
| 3,469,984 | 9/1969 | Bialczak | 96/75 |
| 3,661,590 | 5/1972 | Murphy et al. | 96/49 |
| 3,764,326 | 10/1973 | Yoshida et al. | 96/49 |
| 3,809,560 | 5/1974 | Neuman | 96/49 |

*Primary Examiner*—David Klein
*Assistant Examiner*—Alfonso T. Suro Pico
*Attorney, Agent, or Firm*—Walter C. Kehm; Walter Katz

[57] ABSTRACT

A new and improved developing solution for two-component light-sensitive diazo-type copying materials is described. The solution is a substituted organic diamine formulation which produces dry, high quality diazo prints rapidly, replacing conventional dry ammonia gas systems. The preferred diamine is N-(2-hydroxyethyl)-ethylenediamine alone or with diethylaminopropylamine.

2 Claims, No Drawings

DEVELOPING SOLUTIONS FOR 2-COMPONENT DIAZO-TYPE MATERIALS

BACKGROUND OF THE INVENTION

This invention relates to liquid developers for light-sensitive diazo-type copying materials, and, more particularly, it is concerned with improved liquid organic diamine developing solutions for 2-component diazo processes.

In the conventional dry ammonia gas process, a solution containing the diazo sensitizer, that is, the diazonium compound, one or more couplers, and an organic acid stabilizer, is coated upon a support sheet. The coated sheet then is exposed to light in contact with a translucent original. The latent image so obtained is developed by contacting the sheet with ammonia gas which neutralizes the acid stabilizer and promotes diazo-type coupling between the diazo and coupling materials to produce a dye image of the original. This ammonia process suffers from the disadvantage that ammonia fumes require ducting on the machinery used and extra ventilation in the rooms where the process is carried out.

To overcome this disadvantage of ammonia systems, a semi-wet process has been developed in the art. In this process, exposure is carried out as before. The latent image then is developed by applying an alkaline developing solution to the surface of the sheet. However, dry, high quality prints are difficult to obtain with liquid developers of the prior art. In general, the use of aqueous alkaline solutions produced lower image density than dry ammonia gas; often a less desirable hue is obtained; and development tends to be streaky or non-uniform. The copy sheets also are moist and require some form of drying.

Accordingly, it is an object of the present invention to provide a new and improved liquid developing solution for diazo-type processes.

Another object of the invention is to provide a liquid developing solution which is easy to apply, and which gives dry, high quality prints rapidly in diazo-type machines modified for liquid development using 2-component diazo papers.

A feature of this invention is the provision of an organic diamine developing solution which can be applied in small amounts rapidly and evenly in suitable roller application systems to provide dry, high quality prints quickly without heating and without objectionable pungent fumes from the process.

SUMMARY OF THE INVENTION

These and other advantages and features of the invention are achieved herein by providing a novel developing solution for 2-component diazotype processes which consists essentially of a substituted organic diamine compound in a suitable solvent. In a preferred embodiment of the invention, the substituted organic diamine is N-(2-hydroxyethyl)-ethylenediamine, referred to as "N-(2-HE)-ED," alone, or admixed with diethylaminopropylamine, "DEAPA," in a suitable solvent, as for example, a glycol ether, a glycol, water, and mixtures thereof.

DESCRIPTION OF SPECIFIC EMBODIMENTS OF THE INVENTION

The base component of the developing solution of the present invention is a substituted non-volatile organic diamine, particularly N-(2-hydroxyethyl)-ethylenediamine or diethylaminopropylamine. Other liquid substituted organic diamines, including N-(2-hydroxyethyl)-piperazine, and N-aminoethylpiperazine, which are related chemically to the preferred substituted diamines of the invention, may be used as well for all or part of the diamine component of the developing solution.

The diamine suitably is present in an amount constituting about 10–40% by weight of the developing solution, the remainder being essentially solvent. Preferably the diamine is present in an amount between about 15–25% by weight of the developing solution. When mixtures of N-(2-HE-)-ED and DEAPA are used, the former is present in an amount of 5–40% by weight, and the latter, up to about 10% by weight, of the developing solution.

The solvent comprises about 60–90% by weight of the developing solution, and although non-volatile itself, does provide prints having a dry feel after developing. Suitable solvents include glycol ethers, glycols, water, and mixtures thereof. Typical glycol ethers include diethylene glycol monoethyl ether (ethylcarbitol) and ethylene glycol monoethyl ether (Cellosolve). Typical glycols for use herein are propylene glycol and dipropylene glycol. N-methyl-2-pyrrolidone may be substituted for part or all of the glycol ether and glycol components of the solvent. Water usually comprises the remainder of the solvent. A wetting agent, such as an alkanolamide, usually is present in small amounts in the solution.

In the preferred embodiment of the invention, wherein more nearly optimum results are achieved, the developing solution comprises N-(2-hydroxyethyl)-ethylenediamine in an amount of 10–25% by weight in a glycol ether-glycol-water solution. This developing solution is both nonvolatile and odorless at room temperature, and is capable of producing high quality, substantially dry copies from 2-component diazo paper rapidly using pressure roller applicator printers with only a minimum application of developing solution. The prints thus obtained give a dark image on a white background and do not require any external heating. This solution can be applied evenly in small amounts from suitable liquid diazo machines. The resultant copy after development does not show any tendency to curl.

The developing solution of this invention may be used in connection with any standard 2-component diazo papers commercially available in the art, as for example those supplied by the GAF Corp. or whose formulations are described in detail in U.S. Pat. No. 3,615,485. Copies may be made on suitable liquid developer diazo copying machines, such as the Bruning PD-80 machine, manufactured by the Charles Bruning Division of the Addressograph-Multigraph Corporation, or the moist developer apparatus described in Ser. No. 341,394, filed 3/15/73, now abandoned. The developing solution is prepared by mixing the organic solvents, adding the diamine, then the water, and finally the other components, if any, of the formulation.

Usually no more than 2.5 grams of the present developing solution per square meter of copy surface is necessary to produce high quality prints by pressure development. Even 1–2 grams per square meter will provide sharp contrast prints in less than 1 minute, and usually in about 15 seconds.

The following are specific developer formulations which produce desirable copy prints in accordance with the invention. All amounts are in percent (parts) by weight of the component of the developing solution.

EXAMPLE 1

| | |
|---|---|
| N-(2-hydroxyethyl)-ethylenediamine (N-(2-HE)-ED) | 25 parts |
| Diethyleneglycol monobutyl ether (Butyl Carbitol) | 68 parts |
| Alkanolamide wetting agent - Gafamide CDD-518 (a trademark of GAF Corporation) | 2 parts |
| Water | 5 parts |

The above formulation is initially prepared and used for developing GAF 108S 2-component diazo-copying paper using an application of 1.5 grams per square meter of copying surface in the experimental machine of the aforesaid application. High quality, dry prints are obtained rapidly in the process.

EXAMPLE 2

| | |
|---|---|
| N-(2-HE)-ED | 25 parts |
| Butyl Carbitol- | 41 parts |
| Gafamide CDD-518 | 2 parts |
| N-Methyl - 2-pyrrolidone | 27 parts |
| water | 5 parts |

As in Example 1, high quality prints are obtained using 2.0 grams of developing solution per square meter of copy surface.

EXAMPLE 3

| | |
|---|---|
| N-(2-HE)-ED | 7.5 parts |
| Diethylaminopropylamine (DEAPA) | 9.5 parts |
| Butyl Carbitol | 58.0 parts |
| Dipropylene Glycol | 15.0 parts |
| Water | 10.0 parts |

As in Example 1, high quality prints are obtained with the above formulation using a minimum application of developer solution.

EXAMPLE 4

| | |
|---|---|
| N-(2-HE)-ED | 7.5 parts |
| DEAPA | 9.5 parts |
| Ethyl Carbitol | 58.0 parts |
| Propylene Glycol | 15.0 parts |
| Water | 10.0 parts |

As in Example 1, high quality prints are obtained.

EXAMPLES 5-7

| | EX. 5 | EX. 6 | EX. 7 |
|---|---|---|---|
| N-(2-HE)-ED | 35 pts. | 18 pts. | 25 pts. |
| N-Methyl - 2-pyrrolidone | 62 pts. | 75 pts. | 75 pts. |
| Gafamide CDD-518 | 2 pts. | 2 pts. | 2 pts. |
| Water | 1 pts. | 5 pts. | 5 pts. |

EXAMPLES 8-10

| | EX. 8 | EX. 9 | EX. 10 |
|---|---|---|---|
| N-(2-HE)-ED | 15 pts. | 40 pts. | 10 pts. |
| Butyl Carbitol | 68 pts. | 43 pts. | 73 pts. |
| Dipropylene Glycol | — | — | 5 pts. |
| Gafamide CDD-518 | 2 pts. | 2 pts. | 2 pts. |

-continued

| | EX. 8 | EX. 9 | EX. 10 |
|---|---|---|---|
| Water | 5 pts. | 15 pts. | 10 pts. |

EXAMPLE 11

| | |
|---|---|
| N-(2-HE)-ED | 7.5 parts |
| DEAPA | 7.5 parts |
| Butyl Carbitol | 68.0 parts |
| Dipropylene Glycol | 5.0 parts |
| Gafamide CDD-518 | 2.0 parts |
| Water | 10.0 parts |

EXAMPLE 12

| | |
|---|---|
| N-(2-HE)-ED | 7.5 parts |
| DEAPA | 9.5 parts |
| Ethyl Carbitol | 50.0 parts |
| 1,4-Butanediol | 23.0 parts |
| Water | 10.0 parts |

EXAMPLE 13

| | |
|---|---|
| N-Aminoethylpiperazine | 35.0 parts |
| Ethyl Carbitol | 58.0 parts |
| Gafamide CDD-518 | 2.0 parts |
| Water | 5.0 parts |

EXAMPLE 14

| | |
|---|---|
| N-(2-hydroxyethyl)-piperazine | 25.0 parts |
| Butyl Carbitol | 68.0 parts |
| Gafamide CDD-518 | 2.0 parts |
| Water | 5.0 parts |

EXAMPLE 15

| | |
|---|---|
| DEAPA | 25.0 parts |
| Butyl Carbitol | 68.0 parts |
| Gafamide CDD-518 | 2.0 parts |
| Water | 5.0 parts |

The developing compositions of EXAMPLES 5-15 are applied in a similar manner in the aforementioned moist experimental machine to develop standard 2-component diazo papers with between about 1-2 grams of developing solution per square meter of copying surface. No appreciable odor of the diamine is detectable after developing and the dry copies do not show any tendency to curl upon handling.

In summary, the substituted non-volatile organic diamine-based formulations of the present invention provide improved performance without obnoxious ammonia fumes in commercial copying systems as liquid developers in 2-component diazo-copying systems, in contrast to other available materials, which are deficient in regard to one or more parameters of the copying process. Specifically, the present diamines can be applied to the diazo paper using pressure roller applicator systems readily, using a minimum of material. Furthermore, they produce dry, high quality prints in a short time. The developing solution also is substantially odorless and non-volatile.

While the invention has been described with particular reference to certain embodiments thereof, it will be understood by those skilled in the art that certain modifications and changes may be made which are within the skill of the art, and it is intended to be bound by the appended claims only.

What is claimed is:

1. A developer composition for developing a latent image-bearing 2-component diazo-type material consisting essentially of a mixture of N-(2-hydroxyethyl)-ethylenediamine and diethylaminopropylamine present in an amount of about 10–40% by weight of said composition, the former being present in an amount of about 5–40%, and the latter up to 10% by weight, of said composition, the balance being a suitable solvent selected from the group consisting of a glycol ether, a glycol, N-methyl-2-pyrrolidone and water, and mixtures thereof.

2. developer compositon according to claim 1 wherein said mixture contains about 7.5% of N-(2-hydroxyethyl)-ethylenediamine and about 9.5% of diethylaminopropylamine.

* * * * *